United States Patent [19]

Einhorn

[11] 4,124,189

[45] Nov. 7, 1978

[54] HARD WALL FASTENER

[75] Inventor: Ruediger Einhorn, Katonah, N.Y.

[73] Assignee: Coats & Clark, Inc., Stamford, Conn.

[21] Appl. No.: 811,247

[22] Filed: Jun. 29, 1977

[51] Int. Cl.[2] ..... A47G 1/16

[52] U.S. Cl. ..... 248/489; 248/304

[58] Field of Search ..... 248/479, 489, 494, 495, 248/496, 304, 305, 306, 307, 308, 216.2; 85/31

[56] References Cited

U.S. PATENT DOCUMENTS

| | | | |
|---|---|---|---|
| 3,529,799 | 9/1970 | Schaefer | 248/496 |
| 3,848,843 | 11/1974 | Levy | 248/496 |
| 3,861,639 | 1/1975 | Morrill | 248/489 |
| 4,040,593 | 8/1977 | Wiley | 248/479 |

*Primary Examiner*—Robert A. Hafer

*Attorney, Agent, or Firm*—Burgess, Ryan and Wayne

[57] ABSTRACT

A fastener body has a flat wall mounting surface with a recess in the body containing a fastener insert. The insert has a key for engaging a keyway in the adjacent portion of the fastener body, so that when the insert is only partially disposed in the recess the key and keyway engage each other to prevent relative rotation between the insert body and the fastener body. The fastener body also has a key receiving slot communicating with the keyway so that when the insert is disposed completely within the fastener body recess, i.e., after securing the insert and body to a wall, the fastener body may be rotated relative to the insert to orient said body at a desired angle. Thus, e.g., where the fastener body contains an article supporting hook, the fastener body may be rotated to straighten out the hook in the event that after hammering the fastener body and insert to a mounting wall, the hook is not vertical.

22 Claims, 14 Drawing Figures

HARD WALL FASTENER

This invention relates to an improved hard wall fastener for supporting objects from a vertical mounting surface.

Many types of hard wall fasteners, i.e., fasteners adapted to be secured to a masonry or other relatively hard wall, are known in the art. Generally such fasteners include one or more hardened pins which are driven through the fastener to become embedded in the wall. However, due to the high impact forces (usually generated by a hammer) required to drive the mounting pins into the hard wall, it is common for the fastener body to shift from its desired orientation. Thus, when hard wall fasteners including hooks, e.g., are mounted on the supporting wall, often the mounted hook has a non-vertical orientation, resulting in an undesirable esthetic effect and reducing the effective utility thereof.

Accordingly, an object of the present invention is to provide an improved hard wall fastener which can be realigned after it is fastened to a supporting wall.

Another object of the invention is to provide an improved hard wall fastener comprising an insert body which can be manufactured by relatively economic molding techniques.

Another object of the invention is to provide an improved hard wall fastener of simple unitary construction.

As herein described therein is provided a fastener body having a flat wall mounting surface, a recess in said body, a portion of said rear wall forming the bottom of said recess and separating said recess from said wall mounting surface, said recess having at least one side wall and an open front portion, at least two mounting holes in said rear wall portion, at least one of said holes being elongated to permit rotational movement of said body about mounting elements inserted through said holes, a first keying element integral with a portion of said body remote from said rear wall and coextensive with a side wall of said recess; a fastener insert body dimensioned to fit into said recess, said insert having at least two mounting element guide holes which may be aligned with respective ones of said mounting holes when said insert is in said recess, said insert having a front wall surface, at least one side wall, and a rear wall surface which abuts said rear wall of said fastener body when said insert is in said recess, said guide holes extending between the front and rear surfaces of said insert, and a second keying element integral with said insert adjacent the rear wall thereof and coextensive with said side wall of said insert, said first and second keying elements engaging each other to prevent rotation of said insert relative to said body only when said insert is partially inserted into said recess, with the rear wall of said insert spaced from the bottom of said recess, and means integral with one of said bodies and adjacent a corresponding one of said keying elements for permitting rotational movement of said insert with respect to said fastener body through a predetermined angle, when said insert is disposed in said recess with the rear wall of the insert abutting the bottom of the recess.

According to another aspect of the invention as herein described, there is provided a hardwall fastener comprising a cylindrical insert body having a front surface, a parallel rear surface, a side wall inwardly tapered toward said rear wall, at least one guide hole extending between said front and rear walls, and a hardened pin disposed in said guide hole, said pin having a pointed end adjacent said rear wall and a driving end extending from said front wall.

According to another aspect of the invention as herein described, there is provided a hard wall fastener comprising a fastener body having a flat wall mounting surface, a rear wall adjacent said surface, a recess in said body, a portion of said rear wall forming the bottom of said recess and separating said recess from said wall mounting surface, said recess having at least one side wall and an open front portion; an aperture in said rear wall portion communicating with said recess, a fastener insert dimensioned to fit into said recess, said insert having a front wall surface, at least one side wall, and a rear wall surface which abuts said rear wall of said fastener body when said insert is in said recess, said front and rear wall surfaces being mutually parallel, said insert having a hole of tapered cross section therein extending between the front and rear surfaces thereof, said hole being relatively narrow at said front surface and relatively wide at said rear surface, said hole having a correspondingly tapered interior wall, said aperture communicating with said hole when said insert is disposed in said recess, said aperture having a periphery for guiding an elongated fastening element along a desired portion of said interior wall when said insert is disposed in said recess.

According to still another aspect of the invention as herein described, there is provided a hard wall fastener comprising a generally cylindrical fastener body having a flat wall mounting surface, a rear wall adjacent said surface, a recess in said body, a portion of said rear wall forming the bottom of said recess and separating said recess from said wall mounting surface, a fastener insert body dimensioned to fit into said recess, means comprising mutually communicating holes through said rear wall portion and said insert for mounting said insert and fastener body to a wall, with said insert disposed in said recess, and keying means for inhibiting relative rotational movement between said insert and said fastener body when said insert is partially disposed in said recess, i.e., with the rear wall surface of said insert spaced from the rear wall of said fastener body, and means for permitting relative rotational movement between said insert and fastener body when said insert is disposed within said recess so that the rear wall of the insert abuts the adjacent rear wall of the fastener body.

IN THE DRAWINGS

Figures 1, 2, 3, 4, 5, 6, 7, 8, 9, 10, 11, 12, 13, 14:
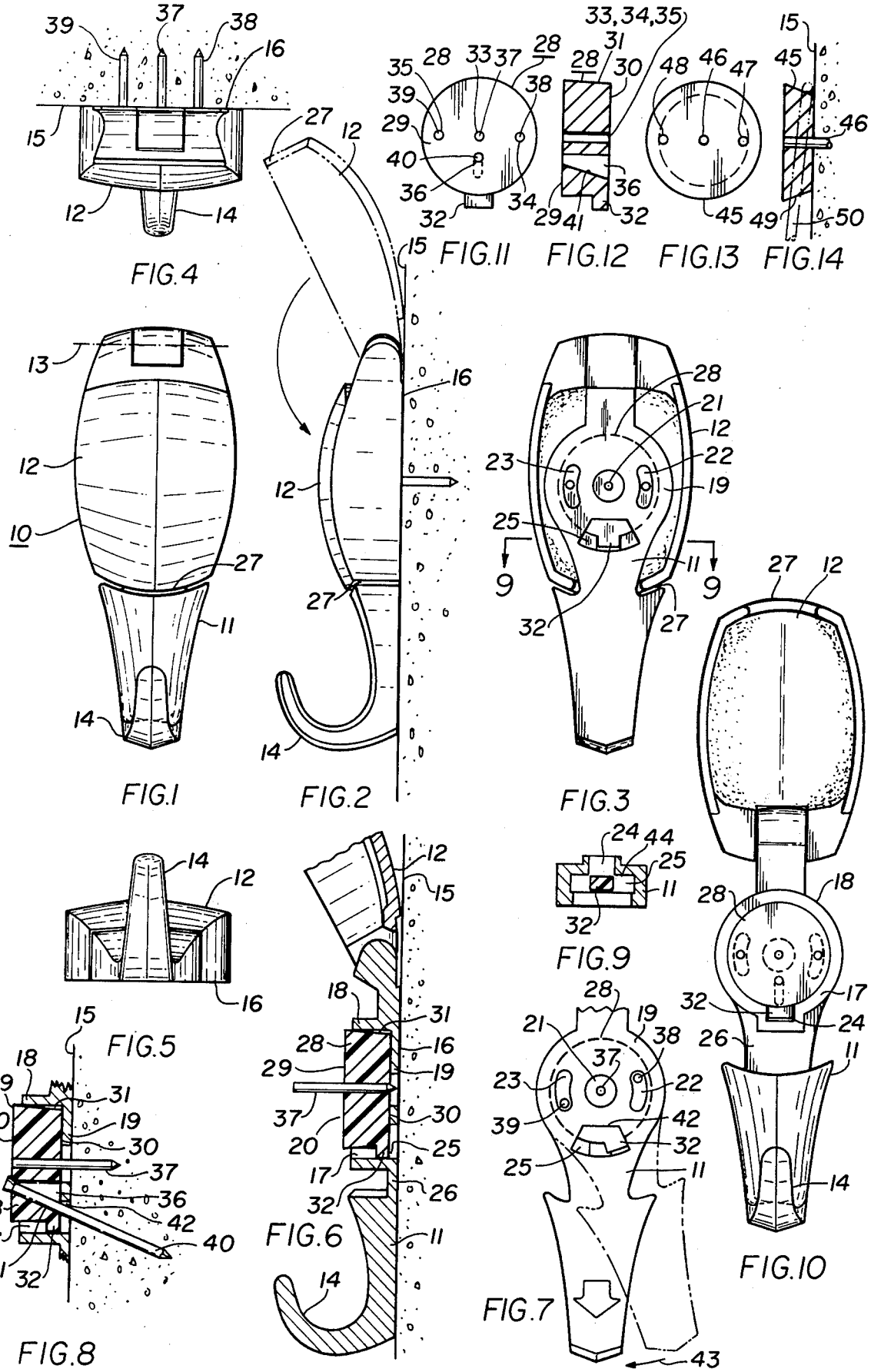
FIG. 1 shows a front elevation view of a hard wall fastener according to the present invention, with the cover thereof in its closed position.
FIG. 2 shows a right side elevation view of the fastener of FIG. 1.
FIG. 3 is a rear elevation view of the fastener of FIG. 1.
FIG. 4 is a top plan view of the fastener of FIG. 1.
FIG. 5 is a bottom plan view of the fastener of FIG. 1.
FIG. 6 is a right side sectional view of the fastener of FIG. 1.
FIG. 7 is a partial rear view of the fastener of FIG. 1, for the purpose of illustrating the alignment feature thereof.
FIG. 8 is a right side sectional view of the insert body of the fastener of FIG. 1 and the adjacent portion of said fastener body.
FIG. 9 is a top sectional view of the fastener shown in FIG. 3, taken along the cutting plane A—A thereof.
FIG. 10 is a front elevation view of the fastener of FIG. 1, with the cover thereof in its open position.
FIG. 11 is a front elevation view of the insert body utilized in the fastener of FIG. 1.
FIG. 12 is a right side sectional view of the insert body of FIG. 11.
FIG. 13 is a front elevation view of a hard wall fastener according to an alternative embodiment of the invention.
FIG. 14 is a right side sectional view of the fastener shown in FIG. 13.

The fastener body 10 shown in FIGS. 1-10 has a main body portion 11, a cover 12 pivotally mounted to the main body portion 11 for rotation about an axis 13, a hook 14 for supporting an article to be mounted on a vertical mounting surface 15, such as a hard wall, a flat wall mounting surface 16 and a generally cylindrical recess 17.

The recess 17 formed in the fastener body 10 has a generally cylindrical surrounding wall 18 and a rear wall 19 which forms the bottom of the recess 17.

The axis of rotation 13 of the cover 12 is parallel to the flat wall mounting surface 16.

The recess 17 has an open front portion 20 facing away from the wall mounting surface 16. The rear wall portion 19 has a central mounting hole 21 therein, and a pair of elongated mounting holes 22 and 23 disposed on opposite sides of said central hole. The elongated holes 22 and 23 have a somewhat arcuate shape, to permit rotational movement of the fastener body 11 about mounting pins inserted through said holes.

Integral with the fastener body 11 and coextensive with the side wall of the recess 17, is a keyway 24. Communicating with the keyway 24, which is disposed adjacent the open front portion 20 of the recess 17 and which extends only part of the way between the open front portion 20 and rear wall 19. A key receiving slot 25 extends from the rear wall 19 and communicates with the keyway 24. Although the key receiving slot 25 need not extend entirely through the rear wall 19, it is preferable that the slot 25 do so in order to simplify the manufacture of fastener 10.

Interconnecting the hook 14 and the wall 18 is a reduced thickness portion 26 of the fastener body 11, for engaging the lower edge 27 of the cover 12.

Disposed in the reeess 17 of the fastener body 11 is a fastener insert body 28, having a generally cylindrical shape, comprising a front wall surface 29, a rear wall surface 30, and a tapered cylindrical side wall 31. The side wall 31 is dimensioned so that the insert 28 fits into the recess 17, with the side wall 31 being slightly tapered inward from the front surface 29 to the rear surface 30 thereof, to facilitate insertion of the insert 28 into the recess 17.

Coextensive with the side wall 31 of the insert 28 is a key 32 having a size slightly less than that of the keyway 24 and dimensioned to fit into said keyway. The thickness of the insert 28 between the front and rear surfaces 29 and 30 thereof is slightly greater than the depth of the recess 17.

The insert 28 has a central guide hole 33 therethrough with peripheral guide holes 34 and 35 extending therethrough on opposite sides of the central guide hole 33, and a tapered guide hole 36 extending therethrough below the guide hole 33. The guide holes 33 to 36 extend between the front and rear surfaces 29 and 30 of the insert body 28.

Disposed in the holes 33-36 are corresponding hard wall fasteners 37-40. Normally, in one mode of use of the fastener 10 the pins 37 to 39 are employed, while in another mode of utilization the pin or nail 40 is employed.

The purpose of the tapered hole 36 is to align the pin or nail 40 at a downwardly inclined angle, to provide improved holding strength when the nail or pin 40 is hammered into the hard wall 15. While an inclined hole (not tapered) could be employed for this purpose, such a hole cannot be fabricated in a simple molding operation. Therefore, in order to reduce manufacturing costs, the tapered hole 36 is employed, with the bottom edge 41 thereof supporting one edge of a nail or pin 40, and the lower edge 42 of the key receiving slot 25 engaging another edge of the nail or pin 40 to retain the same in engagement with the surface 41, as is most clearly shown in FIG. 8.

In order to use the fastener 10, the cover 12 is opened, the fastener body 11 is placed with the flat wall mounting surface 16 thereof against the hard wall 15, the insert body 28 is placed within the recess 17, with the key 32 aligned with the keyway 24, and with the pointed end of each of the pins 37, 38 and 39 adjacent the rear wall 19 of the recess 17, and the driving ends of said pins protruding away from the open front portion 20 of said recess 17. The size and location of the holes 33, 34 and 35 is such that when the key 32 is aligned with the keyway 24, said holes are in communication with the holes 21, 23 and 22 respectively, so that the pins 37 to 39 may be driven further into the respective guide holes 33, 34 and 35, and also through the mounting holes 21, 23 and 22 in the rear wall 19 of the body portion 11 of the fastener 10.

A hammer or other driving tool is then employed to drive the pins 37, 38 and 39 into the hard wall 15, until the driving ends of the pins are substantially co-planar with the front surface 29 of the insert body 28. During this driving step, it is common for the fastener 10 to shift from its desired plumb or vertical position, as indicated by the solid lines in FIG. 7, to an offset or misaligned position, as indicated by the dashed lines in FIG. 7.

Although when the insert body 28 is only partially inserted into the recess 17, rotation of the insert body 28 is prevented by engagement of the key 32 with the keyway 24, when the insert body 28 is fully disposed in the recess 17, i.e., with the rear surface 30 thereof abutting the wall 19 of the fastener body 11, the key 32 moves into the key receiving slot 25, which is substantially wider than the keyway 24, and thus permits rotation of the insert 28 through a predetermined angle with respect to the fastener body 11.

Thus, after the pins 37, 38 and 39 have been driven into the wall 15, thus also securing the insert body 28 within the recess 17, the fastener body 11 may be located in the direction of the arrow 43 shown in FIG. 7, to return the fastener 10 to its desired vertical orientation. The rotational motion of the fastener body 11 which occurs during this realignment step causes the elongated holes 22 and 23 to "rotate" with respect to the pins 38 and 39, and the hole 21 to rotate about the concentric pin 37, while at the same time causing the key receiving slot 25 to rotate with respect to the key 32, to "lock" the key 32 into the space between the key receiving slot 25 and the adjacent shoulder portion 44 of the fastener body 11.

The width of the key receiving slot 25 may be such that rotational motion of the fastener body 11 with respect to the fastener insert 28 is limited to plus or minus 20° either side of the vertical direction, with an angular limit of plus or minus 10° being preferred.

Preferably, the fastener body 11 and cover 12 are manufactured of a die casting metal such as zinc, while the insert body 28 is manufactured of a relatively resilient plastic such as nylon.

Rather than employing a key 32 on the insert body 28 and a corresponding keyway 24 and key receiving slot 25 communicating with the recess 17, the key arrangement may be reversed if desired, i.e., by providing a key integral with the wall 18 of the recess 17, and a corresponding key way and key receiving slot formed in the insert body 28.

The pins 37 to 40 may preferably be formed of a hardened steel material.

After the fastener 10 has been secured to the wall 15 by driving the pins 37 and 39 and the fastener body 11 has been satisfactorily aligned with the vertical (or another desired direction), the cover 12 is rotated to its closed position as shown in FIG. 1 to hide the recess 17 and the insert 28, to thereby provide an attractive and esthetic appearance for the fastener 10.

If desired, additional support for the fastener 10 may be provided by driving a nail or pin 40 through the tapered hole 36 of the insert body 28 and the key receiving slot 25 of the rear wall 19 of the fastener body 11, after the pins 37 to 39 have been driven into the wall 15, and the fastener body 11 has been rotated to align the same in the desired orientation. The cover 12 would, of course, be closed after the nail or pin 40 has been driven into the wall 15.

FIGS. 13 and 14 show a simple hard wall fastener construction employing a tapered cylindrical body 45 having three guide holes therein in which hardened pins 46, 47 and 48 are disposed. Preferably, the fastener 45 is made of nylon or another relatively resilient material. The side wall 49 of the fastener 45 is tapered in the direction toward the wall 15 to which the fastener is mounted, so that after the fastener 45 is installed by driving the pins 46 to 48 into the wall 15, a wire or cord 50 may be suspended from the fastener 45 and retained thereby due to the taper of the side wall 49 of said fastener.

What is claimed:

1. A hard wall fastener comprising:

a fastener body having a flat wall mounting surface, a rear wall adjacent said surface, a recess in said body, a portion of said rear wall forming the bottom of said recess and separating said recess from said wall mounting surface, said recess having at least one side wall and an open front portion;

at least two mounting holes in said rear wall portion, at least one of said holes being elongated to permit rotational movement of said body about mounting elements inserted through said holes;

a first keying element integral with a portion of said body remote from said rear wall and coextensive with a side wall of said recess;

a fastener insert body dimensioned to fit into said recess, said insert having at least two mounting element guide holes which may be aligned with respective ones of said mounting holes when said insert is in said recess, said insert having a front wall surface, at least one side wall, and a rear wall surface which abuts said rear wall of said fastener body when said insert is in said recess, said guide holes extending between the front and rear surfaces of said insert; and a second keying element integral with said insert adjacent the rear wall thereof and coextensive with said side wall of said insert, said first and second keying elements engaging each other to prevent rotation of said insert relative to said body only when said insert is partially inserted into said recess, with the rear wall of said insert spaced from the bottom of said recess, and means integral with one of said bodies and adjacent a corresponding one of said keying elements for permitting rotational movement of said insert with respect to said fastener body through a predetermined angle, when said insert is disposed in said recess with the rear wall of the insert abutting the bottom of the recess.

2. The fastener according to claim 1, further comprising first and second hardened pins disposed in respective ones of said guide holes, each pin having a pointed end adjacent said rear wall of said insert and a driving end extending from said front wall of said insert.

3. The fastener according to claim 1, wherein said recess and said insert are generally cylindrical.

4. The fastener according to claim 3, wherein one of said mounting holes is centrally disposed in the bottom wall of said recess.

5. The fastener according to claim 3, wherein said first keying element comprises a keyway and said second keying element comprises a key.

6. The fastener according to claim 5, wherein said means comprises a key receiving slot wider than said keyway.

7. The fastener according to claim 1, further comprising a hook integral with said fastener body.

8. The fastener according to claim 7, further comprising a cover pivotally mounted to said fastener body for rotation, about an axis parallel to said mounting surface, between an open position in which said recess is exposed and a closed position in which said recess and insert therein are hidden by said cover.

9. The fastener according to claim 3, wherein the side wall of said insert is tapered toward the rear wall thereof to facilitate insertion of said insert into said recess.

10. The fastener according to claim 1, wherein said insert has a hole of tapered cross section therein extending between the front and rear walls thereof, said hole being relatively narrow at said front wall and relatively wide at said rear wall, said hole having a correspondingly tapered interior wall, said fastener body having a guide aperture in said rear wall portion for guiding an elongated fastening element along a desired portion of said interior wall when said keying elements are engaged.

11. The fastener according to claim 1, wherein said predetermined angle is on the order of ± 10° to ± 20° with respect to the aligned positions of said keying elements.

12. A hardwall fastener comprising a cylindrical body having a front wall of given diameter, a parallel rear wall of lesser diameter than said front wall, a side wall inwardly tapered toward said rear wall, at least one guide hole extending between said front and rear walls, a tapered hole of constant width extending between said front and rear walls with a larger diameter aperture of said rear wall and a smaller diameter aperture at said front wall, said hole having a cylindrical cross-section at said front wall and a slot-shaped cross-section at said rear wall, and a hardened pin disposed in one of said holes, said pin having a pointed end adjacent said rear wall and a driving end extending from said front wall.

13. A hard wall fastener comprising:

a fastener body having an integral hook depending therefrom, said body including a flat wall mounting surface, a rear wall adjacent said surface, a recess in said body, a portion of said rear wall forming the bottom of said recess and separating said recess from said wall mounting surface, said recess having a generally cylindrical side wall and an open front portion, a central mounting hole and two additional mounting holes disposed on opposite sides of said central hole, said additional holes being elongated to permit rotational movement of said body about mounting elements inserted through said holes, a key slot extending through said body in a direction perpendicular to said mounting surface, said slot having a relatively narrow portion remote from said mounting surface and a relatively wide portion adjacent said mounting surface, said slot communicating with said mounting surface and said recess;

a cylindrical fastener insert dimensioned to fit into said recess, said insert having three mounting element guide holes which may be aligned with respective ones of said mounting holes when said insert is in said recess, said insert having a front surface, a side wall, and a rear surface which abuts said rear wall of said fastener body when said insert is in said recess, said guide holes extending between the front and rear surfaces of said insert, and a protruding key integral with said insert adjacent the rear wall thereof and coextensive with said side wall of said insert, said key extending only a portion of the distance between said front and rear insert surfaces, the width of said key being slightly less than the width of the relatively narrow portion of said slot, whereby when said insert is partially inserted into said recess so that said key engages the relatively narrow portion of said slot, rotational movement of said insert with respect to said fastener body is prevented, and when said insert is inserted into said recess so that the rear wall thereof abuts the bottom of the recess, said key is disposed within the relatively wide portion of said slot, permitting rotational movement of said insert with respect to said fastener body through a predetermimed angle.

14. The fastener according to claim 13, further comprising first, second and third hardened pins disposed in respective ones of the guide holes of said insert, each pin having a sharpened end adjacent the rear surface of the insert, and a driving end extending from the front surface thereof.

15. The fastener according to claim 13, wherein the side wall of said insert is tapered inwardly toward the rear surface thereof.

16. The fastener according to claim 13, wherein said insert has a hole of tapered cross section therein extending between the front and rear surfaces thereof, said hole being relatively narrow at said front wall and relatively wide at said rear wall, said hole having a correspondingly tapered interior wall, the portion of said slot communicating with said mounting surface having a peripheral portion for guiding an elongated fastening element along a desired portion of said interior wall when said key is disposed in said slot.

17. The fastener according to claim 13, wherein the relatively wide portion of said slot permits rotation of said insert with respect to said fastener body through a total angle on the order of 20° to 40°.

18. The fastener according to claim 13, wherein said central hole in said portion of said rear wall of said fastener body is substantially larger than the corresponding guide hole in said insert.

19. The fastener according to claim 13, further comprising a cover pivotally mounted to said fastener body for rotation, about an axis parallel to said mounting surface, between an open position in which said recess is exposed and a closed position in which said recess and insert therein are hidden by said cover.

20. A hard wall fastener comprising:

a fastener body having a flat wall mounting surface, a rear wall adjacent said surface, a recess in said body, a portion of said rear wall forming the bottom of said recess and separating said recess from said wall mounting surface, said recess having at least one side wall and an open front portion;

an aperture in said rear wall portion communicating with said recess;

a fastener insert dimensioned to fit into said recess, said insert having a front wall surface, at least one side wall, and a rear wall surface which abuts said rear wall of said fastener body when said insert is in said recess, said front and rear wall surfaces being mutually parallel, said insert having a hole of tapered cross section therein extending between the front and rear surfaces thereof, said hole being relatively narrow at said front surface and relatively wide at said rear surface, said hole having a correspondingly tapered interior wall, said aperture communicating with said hole when said insert is disposed in said recess, said aperture having a periphery for guiding an elongated fastening element along a desired portion of said interior wall when said insert is disposed in said recess.

21. The fastener according to claim 20, wherein said recess and said insert are cylindrical.

22. A hard wall fastener comprising:

a generally cylindrical fastener body having a flat wall mounting surface, a rear wall adjacent said surface, a recess in said body, a portion of said rear wall forming the bottom of said recess and separating said recess from said wall mounting surface, a fastener insert body dimensioned to fit into said recess, means comprising mutually communicating holes through said rear wall portion and said insert for mounting said insert and fastener body to a wall, with said insert disposed in said recess, and keying means for inhibiting relative rotational movement between said insert and said fastener body when said insert is partially disposed in said recess, i.e., with the rear wall surface of said insert spaced from the rear wall of said fastener body, and means for permitting relative rotational movement between said insert and fastener body when said insert is disposed within said recess so that the rear wall of the insert abuts the adjacent rear wall of the fastener body.

* * * * *